US009115917B2

(12) United States Patent
Hokazono et al.

(10) Patent No.: US 9,115,917 B2
(45) Date of Patent: Aug. 25, 2015

(54) AIR-CONDITIONER AND METHOD OF RETURNING AND COOLING COMPRESSOR OIL

(75) Inventors: Keisuke Hokazono, Tokyo (JP); Yutaka Aoyama, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 437 days.

(21) Appl. No.: 13/139,942

(22) PCT Filed: Jan. 27, 2009

(86) PCT No.: PCT/JP2009/051233

§ 371 (c)(1), (2), (4) Date: Jun. 15, 2011

(87) PCT Pub. No.: WO2010/086954

PCT Pub. Date: Aug. 5, 2010

(65) Prior Publication Data

US 2012/0103003 A1 May 3, 2012

(51) Int. Cl.

*F25B 43/02* (2006.01)
*F25B 13/00* (2006.01)
*F25B 31/00* (2006.01)

(52) U.S. Cl.

CPC ..... *F25B 13/00* (2013.01); *F25B 31/004* (2013.01); *F25B 2313/006* (2013.01); *F25B 2313/0233* (2013.01); *F25B 2313/02741* (2013.01);

(Continued)

(58) Field of Classification Search

CPC .... F25B 31/002; F25B 43/02; F25B 2400/02; F25B 43/00; F25B 2500/16; F25B 2700/03

USPC ..... 62/84, 471, 468, 192

See application file for complete search history.

(56) References Cited

U.S. PATENT DOCUMENTS 2,589,384 A * 3/1952 Hopkins ..... 62/160
5,027,606 A * 7/1991 Short ..... 62/84

(Continued)

FOREIGN PATENT DOCUMENTS

EP 0924478 A2 6/1999
JP 4-203764 A 7/1992

(Continued)

OTHER PUBLICATIONS

Machine Translation of JP411264622A.*

(Continued)

*Primary Examiner* — Cheryl J Tyler
*Assistant Examiner* — David Teitelbaum
(74) *Attorney, Agent, or Firm* — Buchanan Ingersoll & Rooney PC

(57) ABSTRACT

An air-conditioner capable of suppressing increase in the suction temperature of a compressor is provided. The air-conditioner according to the present invention has a refrigerant circuit in which a compressor, an oil separator, a heat source side heat exchanger, a throttle device, and a use side heat exchanger are connected in series, an oil returning circuit that connects the oil separator with the suction side of the compressor, and a decompression mechanism provided in the oil return circuit. The oil return circuit is installed by piping so as to exchange heat with a part of the heat source side heat exchanger at the upstream side of the decompression mechanism.

3 Claims, 5 Drawing Sheets

(52) U.S. Cl.
CPC ..... *F25B2400/05* (2013.01); *F25B 2400/13* (2013.01); *F25B 2500/08* (2013.01)

(56) References Cited

U.S. PATENT DOCUMENTS

| | | | | |
|---|---|---|---|---|
| 5,899,091 | A * | 5/1999 | Fraser et al. | 62/473 |
| 6,058,727 | A * | 5/2000 | Fraser et al. | 62/190 |
| 6,167,722 | B1 * | 1/2001 | Kasezawa et al. | 62/513 |
| 6,895,768 | B2 * | 5/2005 | Sakamoto et al. | 62/196.4 |
| 7,167,264 | B2 * | 1/2007 | Takamiya | 358/1.15 |
| 2005/0028552 | A1 * | 2/2005 | Nishijima et al. | 62/500 |
| 2007/0039351 | A1 * | 2/2007 | Bai | 62/513 |
| 2007/0107451 | A1 | 5/2007 | Sakurai et al. | |

FOREIGN PATENT DOCUMENTS

| | | | | |
|---|---|---|---|---|
| JP | 05-340616 | A | 12/1993 | |
| JP | 6-337171 | A | 12/1994 | |
| JP | 11-325617 | A | 9/1998 | |
| JP | 11-118266 | A | 4/1999 | |
| JP | 411264622 | a * | 10/1999 | F25B 13/00 |
| JP | 10-253179 | A | 11/1999 | |
| JP | 2002-206815 | A | 7/2002 | |
| JP | 2003-279169 | A | 10/2003 | |
| JP | 2004-150746 | A | 5/2004 | |
| JP | 2004-340410 | A | 12/2004 | |
| JP | 3866359 | B2 | 1/2007 | |
| JP | 2007-078318 | A | 3/2007 | |
| JP | 2007-139225 | A | 6/2007 | |
| JP | 2008-032275 | A | 2/2008 | |
| WO | 2008/102454 | A1 | 8/2008 | |

OTHER PUBLICATIONS

Machine Translation JP2002-206815A.*

International Search Report (PCT/ISA/210) issued on May 12, 2009, by Japanese Patent Office as the International Searching Authority for International Application No. PCT/JP2009/051233.

Office Action (Notification of Reason for Refusal) dated Oct. 2, 2012, issued by the Japanese Patent Office in the corresponding Japanese Patent Application No. 2010-548275 and an English translation thereof. (3 pages).

Office Action (Decision of Refusal) dated Jun. 4, 2013, issued by the Japanese Patent Office in the corresponding Japanese Patent Application No. 2010-548275, and an English translation thereof. (4 pages).

Jun. 3, 2014 Japanese Office Action issued in Japanese Patent Application No. 2010-548275/ Appeal No. 2013-15914.

Extended European Search Report dated Jun. 3, 2014, issued by the European Patent Office in corresponding European Patent Application No. 09839146.9 (5 pgs).

* cited by examiner $$Q = Gr \times \Delta I = Gr' \times \Delta I'$$
$$Gr > Gr'$$
$$\Delta I < \Delta I'$$

AIR-CONDITIONER AND METHOD OF RETURNING AND COOLING COMPRESSOR OIL

TECHNICAL FIELD

The present invention relates to an air-conditioner having a refrigerant circuit and a method of returning refrigerator oil discharged along with a refrigerant from a compressor constituting the refrigeration cycle thereof to the compressor.

BACKGROUND ART

In an air-conditioner having a refrigerant circuit (refrigeration cycle) represented by a multi air-conditioner for buildings, in which a plurality of load-side indoor units is connected and each indoor unit is operated separately, refrigerator oil is discharged along with a refrigerant from a compressor. In such an air-conditioner, conventionally, an oil separator has been disposed in general at the secondary side (discharge side) of the compressor for the purpose of reducing the distribution amount of the refrigerator oil brought out of the compressor in the refrigeration circuit to immediately return to the compressor. (Refer to Patent Document 1, for example)

Reasons for disposing the oil separator are given as follows. First, as a connecting pipe (refrigerant pipe) that links a heat source unit (outdoor unit) with an indoor unit becomes longer, the amount of refrigerator oil distributed in the connecting pipe increases and a necessary oil amount in the compressor possibly runs short. Second, since a plurality of indoor units separately start/stop, the refrigerator oil is sometimes accumulated in the suspended indoor unit. Third, when the refrigerant stagnates in the compressor and the compressor is started under the condition that oil is diluted, it takes time for the compound liquid of the brought-out refrigerant and refrigerator oil to return to the compressor after circulating in the refrigerant circuit, resulting in the lowering of reliability of the compressor possibly.

In the air-conditioner described in Patent Literature 1, the refrigerator oil brought out of the compressor is adapted to be separated into a high-pressure high-temperature gas refrigerant and refrigerator oil by an oil separator. Then, the high-pressure high-temperature gas refrigerant flows into a heat source side heat exchanger and the separated refrigerator oil is returned to the primary side (suction side) of the compressor under low-pressure low-temperature conditions after being decompressed by a decompression apparatus. At that time, part of the high-pressure high-temperature gas refrigerant is decompressed by the decompression apparatus along with the refrigerator oil and returned to the suction side of the compressor under the low-pressure high-temperature condition at the same time with the refrigerator oil.

Reasons for returning oil to the primary side of the compressor are given as follows. First, the refrigerator oil discharged from the compressor along with the refrigerant and brought out from the compressor needs to be returned to the compressor without delay. Second, the refrigerator oil discharged from the compressor along with the refrigerant and brought out from the compressor needs to be returned to the compressor before the concentration of the refrigerator oil in the compressor becomes extremely lowered.

CITATION LIST

Patent Literature

Patent Literature 1 Japanese Patent No. 3866359 (Embodiment 8, FIG. 9)

SUMMARY OF INVENTION

Technical Problem

In the related art air-conditioner described in Patent Literature 1, while a refrigerator oil brought out of the compressor used to be directly returned to a suction opening, which is the primary side of the refrigerator, for the purpose of securing the amount of the refrigerator oil in the compressor, there are problems as shown below. By directly returning the low-pressure high-temperature refrigerator oil and gas refrigerant to the suction opening of the compressor, a temperature increases and a refrigerant density is lowered at the suction opening of the compressor, and a refrigerant circulation amount of the compressor is lowered, resulting in deterioration of the performance of the compressor. That is, power consumption necessary to meet predetermined capacity of the compressor increases. Further, since the suction temperature of the compressor increase, the discharge temperature of the compressor is apt to increase as well, causing the temperature rise in a motor wiring to affect reliability of the compressor.

The present invention is made to solve the above problems, and a first object is to provide an air-conditioner and a method of returning refrigerator oil that enable to suppress the rise in the suction temperature of the compressor. In addition to the first object, a second object is to provide the air-conditioner and the method of returning the refrigerator oil whose performance is further improved by transferring the refrigerant flow amount bypassed to the suction side of the compressor to the refrigerant circulation amount to a load side.

Solution to Problem

An air-conditioner according to the present invention has a refrigerant circuit in which a compressor, an oil separator, a heat source side heat exchanger, a throttle device, and a use side heat exchanger are connected in order, an oil return circuit that connects the oil separator with the suction side of the compressor, and a decompression mechanism provided in the oil return circuit. The oil return circuit is installed by piping so as to exchange heat with at least part of the heat source side heat exchanger at the upper stream side of the decompression mechanism.

A method of returning refrigerator oil according to the present invention is a method of refrigerator oil used in the above air-conditioner. The refrigerator oil separated by the oil separator is led to a portion of the heat source side heat exchanger along with part of the remaining refrigerant without being separated by the oil separator and, after releasing heat, is returned to the suction side of the compressor.

Advantageous Effects of Invention

In accordance with the air-conditioner and the method of returning oil according to the present invention, since the high-pressure high-temperature gas refrigerant and the refrigerator oil separated by the oil separator are led to a portion of the heat source side heat exchanger, and are returned to the compressor after being made to release heat, an increase of a compressor suction temperature can be suppressed and performance can be improved. By suppressing the increase of the compressor suction temperature, an increase of a compressor discharge temperature can be suppressed as well, enabling to contribute to the improvement of reliability of the compressor such as suppressing an increase of a motor wiring temperature.

DESCRIPTION OF EMBODIMENTS

Descriptions will be given to embodiments of the present invention based on drawings.

Embodiment 1

Figure 1:
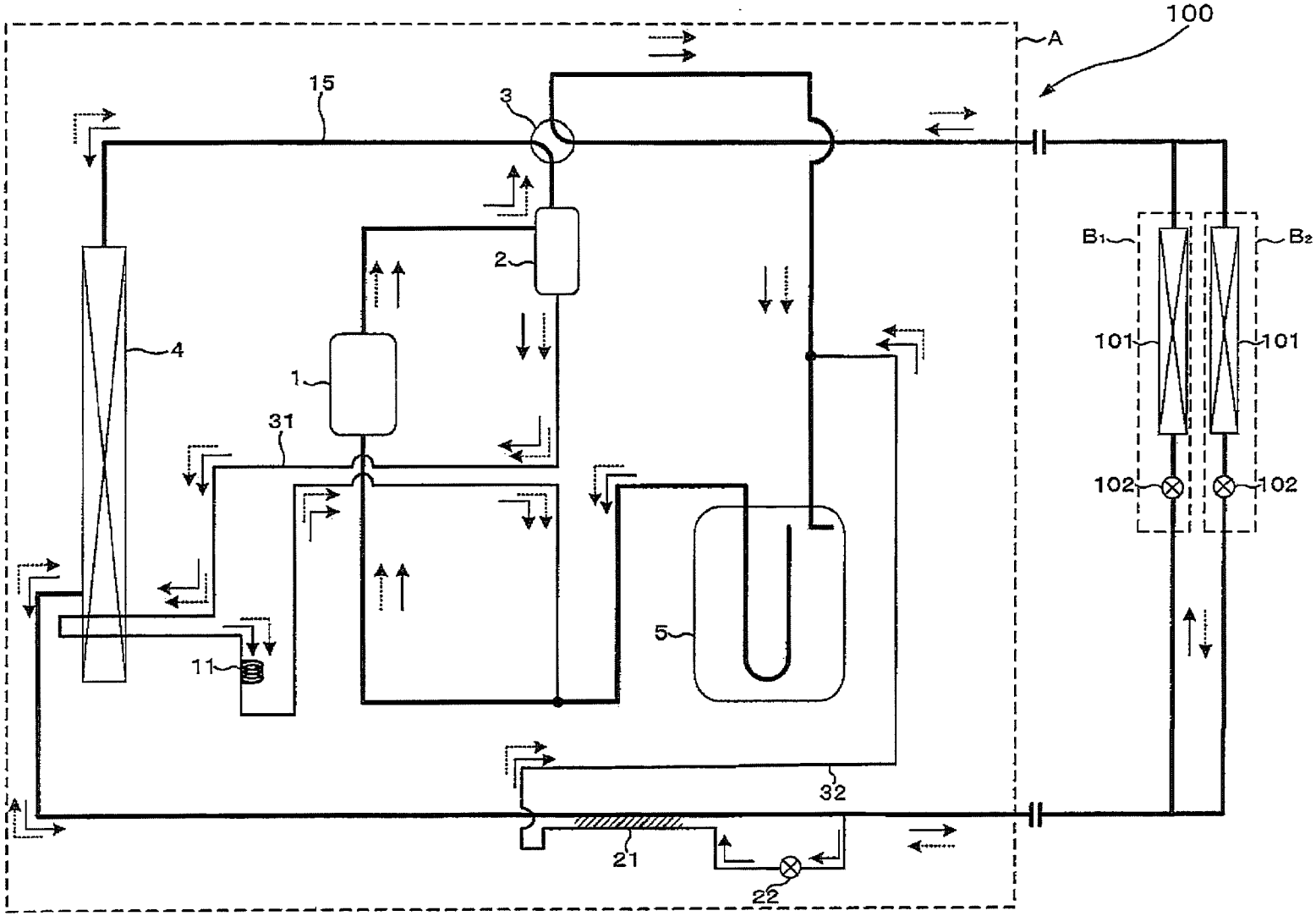
FIG. 1 is a refrigerant circuit diagram showing a refrigerant circuit configuration of an air-conditioner according to Embodiment 1.

FIG. 1 is a refrigerant circuit diagram showing a refrigerant circuit configuration of an air-conditioner 100 according to Embodiment of the present invention. Based on FIG. 1, descriptions will be given to the refrigerant circuit configuration and operations of the air-conditioner 100, which is a refrigeration cycle apparatus. The air-conditioner 100 performs a cooling operation or a heating operation using a refrigeration cycle (heat pump cycle) that makes the refrigerant circulate. In FIG. 1, solid line arrows denote the refrigeration circuit at the time of the cooling operation and dotted line arrows denote the refrigeration circuit at the time of the heating operation, respectively. In some case, in the drawings below including FIG. 1, relations of sizes of each constituting member may be different from actual ones.

As shown in FIG. 1, the air-conditioner 100 is constituted by an outdoor unit (heat source unit) A and two indoor units (indoor unit $B_1$ and indoor unit $B_2$) connected in parallel with the outdoor unit A. The outdoor unit A and the indoor unit B are connected with a refrigerant pipeline 15 constituted by a gas pipeline and a liquid pipeline. Consequently, the air-conditioner 100 configures a refrigerant circuit by the outdoor unit A and the indoor unit B. A cooling operation and a heating operation are possible to be realized by making a refrigerant circulate in the refrigerant circuit. In the descriptions as follows, the indoor unit $B_1$ and indoor unit $B_2$ are combined and referred to as an indoor unit B in some case. The number of the outdoor unit A and the indoor unit B, which are connected, is not limited to the number shown in the drawings.

Outdoor Unit A

The outdoor unit A has a function to feed cooling energy to the indoor unit B. In the outdoor unit A, the compressor 1, an oil separator 2, a four-way valve 3, a heat source side heat exchanger 4, a refrigerant-refrigerant heat exchanger 21, and an accumulator 5 are provided so as to be connected in series at the time of the cooling operation. In the outdoor unit A, an oil returning circuit 31 is provided that connects the oil separator 2 with the suction side of the compressor 1 via the heat source side heat exchanger 4 and the decompression mechanism 11. Further, in the outdoor unit A, a bypass circuit 32 is provided that connects the downstream side (condensation side) of the refrigerant-refrigerant heat exchanger 21 at the time of the cooling operation with the upstream side of the accumulator 5 via the super-cooling expansion valve 22 and the evaporation side of the refrigerant-refrigerant heat exchanger 21.

The first compressor 1 sucks and compresses the refrigerant to turn it into a high-pressure high-temperature state and may be configured by a capacity-controllable inverter compressor, for example. The oil separator 2 is provided at the discharge side of the compressor 1 to separate a refrigerator oil component from a refrigerant gas discharged from the compressor 1 and mixed with refrigerator oil. The four-way valve 3 functions as a flow path switching device that switches refrigerant flows and switches the refrigerant flow at the time of the cooling operation and the refrigerant flow at the time of the heating operation. The heat source side heat exchanger 4 functions as a condenser (a radiator) at the time of the cooling operation and as an evaporator at the time of the heating operation and exchanges heat between the air supplied from a blower such as a fan, which is not shown, and the refrigerant so as to condense-liquefy (or turns it into a high-density super-critical state) or evaporate-gasify the refrigerant.

The refrigerant-refrigerant heat exchanger 21 exchange heat between the refrigerant flowing through the refrigerant pipeline 15 and the refrigerant flowing through the bypass circuit 32. The accumulator 5 is provided at the primary side (suction side) of the compressor 1 to store a surplus refrigerant. The oil returning circuit 31 returns the refrigerator oil and part of refrigerant separated by the oil separator 2 to the suction side of the compressor 1 via a part (here, a part where the wind speed distribution of the heat source side heat exchanger 4 is the minimum (refer to FIG. 2)) of the heat source side heat exchanger 4 and the decompression mechanism 11. The decompression mechanism 11 is provided at the downstream side of the heat source side heat exchanger 4 in the oil returning circuit 31 to decompress the refrigerant flowing through the oil returning circuit 31. The decompression mechanism 11 may be configured by those whose opening degree is variably controllable, for example, an electronic expansion valve and a capillary and the like.

The bypass circuit 32 bypasses part of the refrigerant super-cooled in the refrigerant-refrigerant heat exchanger 21 to the upstream side of the accumulator 5 via the super-cooling expansion valve 22 and the refrigerant-refrigerant heat exchanger 21. The super-cooling expansion valve 22 is provided at the upstream side (evaporation side) of the refrigerant-refrigerant heat exchanger 21 of the bypass circuit 32 at the time of the cooling operation to decompress and expand the refrigerant flowing through the bypass circuit 32. The super-cooling expansion valve 22 may be configured by those whose opening degree is variably controllable, for example, an electronic expansion valve and the like.

Indoor Unit B

The indoor unit B is disposed in a room having an area to be air-conditioned or the like and has a function to supply air for cooling or heating to the area to be air-conditioned. In the indoor unit B, a use side heat exchanger 101 and a throttle device 102 are connected in series and disposed. The use side heat exchanger 101 functions as an evaporator at the time of the cooling operation and as a condenser (a radiator) at the time of the heating operation to exchange heat between the air supplied by a blower such as a fan, which is not shown, and the refrigerant and prepares heating air or cooling air for supplying the same to the area to be air-conditioned. The throttle device 102 decompresses and expands the refrigerant to adjust the refrigerant distribution to the use side heat exchanger 101. The throttle device 102 may be configured by an electronic expansion valve and the like whose opening degree is variable.

Descriptions will be given to the refrigerant flow at the time of various operations of the air-conditioner 100.

When the air-conditioner 100 performs cooling operation (solid line arrows), the four-way valve 3 is switched so that the refrigerant discharged from the compressor 1 flows into the heat source side heat exchanger 4 and the compressor 1 is driven. The refrigerant sucked by the compressor 1 turns into a high-pressure high-temperature gas state in the compressor 1 and is discharged to flow into the heat source side heat exchanger 4 via the oil separator 2 and the four-way valve 3. The refrigerant flowed into the heat source side heat exchanger 4 is cooled while releasing heat into the air supplied from the blower, which is not shown, and turns into a low-pressure high-temperature liquid refrigerant to flow out from the heat source side heat exchanger 4.

The liquid refrigerant flowing out from the heat source side heat exchanger 4 flows into the indoor unit B. The refrigerant flowed into the indoor unit B is decompressed by the throttle device 102 to turn into a low-pressure two-phase refrigerant. The low-pressure two-phase refrigerant flows into the use side heat exchanger 101 to evaporate and gasify by absorbing heat supplied by the air from a blower, which is not shown. Then, cooling air is supplied into the space to be air-conditioned such as inside of the room and cooling operation in the space to be air-conditioned is achieved. The refrigerant flowed out from the use side heat exchanger 101 flows out of the indoor unit B, flows into the outdoor unit A, passes through the four-way valve 3 and the accumulator 5 of the outdoor unit A, and absorbed by the compressor 1 again.

When the air-conditioner 100 performs a heating operation (broken line arrows), the four-way valve 3 is switched so that the refrigerant discharged from the compressor 1 flows into the use side heat exchanger 101 and the compressor 1 is driven. The refrigerant sucked by the compressor 1 turns into a high-pressure high-temperature gas state in the compressor 1 and is discharged to flow into the use side heat exchanger 101 via the oil separator 2 and the four-way valve 3. The refrigerant flowed into the heat source side heat exchanger 101 is cooled while releasing heat into the air supplied from a blower, which is not shown, to turn into a low-pressure high-temperature liquid refrigerant. Then, heating air is supplied into the space to be air-conditioned such as inside of the room and heating operation in the space to be air-conditioned is achieved.

The liquid refrigerant flowed out of the use side heat exchanger 101 is decompressed by the throttle device 102 to turn into a low-pressure two-phase refrigerant. The low-pressure two-phase refrigerant flows out of the indoor unit B to flow into the outdoor unit A. The low-pressure two-phase refrigerant flowed into the outdoor unit A flows into the heat source side heat exchanger 4 to evaporate and gasify by absorbing heat from the air supplied by the blower, which is not shown. The low-pressure gas refrigerant flows out of the heat source side heat exchanger 4 and passes through the four-way valve 3 and the accumulator 5 to be sucked by the compressor 1 again.

Incidentally, the refrigerator oil brought out of the compressor 1 along with the refrigerant flows into the oil separator 2 and is separated from the high-pressure gas refrigerant in the oil separator 2. However, in the oil separator 2, the high-pressure gas refrigerant and the refrigerator oil are not always separated completely (100%). The oil separator 2 can separate almost 90% of the refrigerator oil, for example. The remaining almost 10% of the refrigerator oil is not separated and circulates in the refrigerant circuit with the refrigerant. In the oil separator 2, the high-pressure high-temperature gas refrigerant does not always flow into the refrigerant circuit completely, as well. The oil separator 2 can separate approximately 97 to 98% of refrigerant, for example. The remaining approximately 2 to 3% of the high-pressure high-temperature gas refrigerant is adapted to be finally returned to the compressor 1 with the refrigerator oil.

Part of the high-pressure high-temperature gas refrigerant and the refrigerator oil separated in the oil separator 2 flows into a portion of the heat source side heat exchanger 4 through the oil returning circuit 31 to the compressor 1. In FIG. 1, the oil returning circuit 31 may pass through the portion of the heat source side heat exchanger 4 that is, for example, a part where the wind speed distribution on the surface of the heat exchanger is the smallest (a part having poor contribution as heat exchange amount). The high-pressure high-temperature gas refrigerant flowed into the portion of the heat source side heat exchanger 4 turns into a high-pressure medium-temperature liquid state by releasing heat in the heat source side heat exchanger 4 to flow into the decompression mechanism 11. In the decompression mechanism 11, the high-pressure medium-temperature liquid refrigerant is decompressed to be low-pressure low-temperature and returned to the suction side of the compressor 1 with the refrigerator oil.

Figure 2:
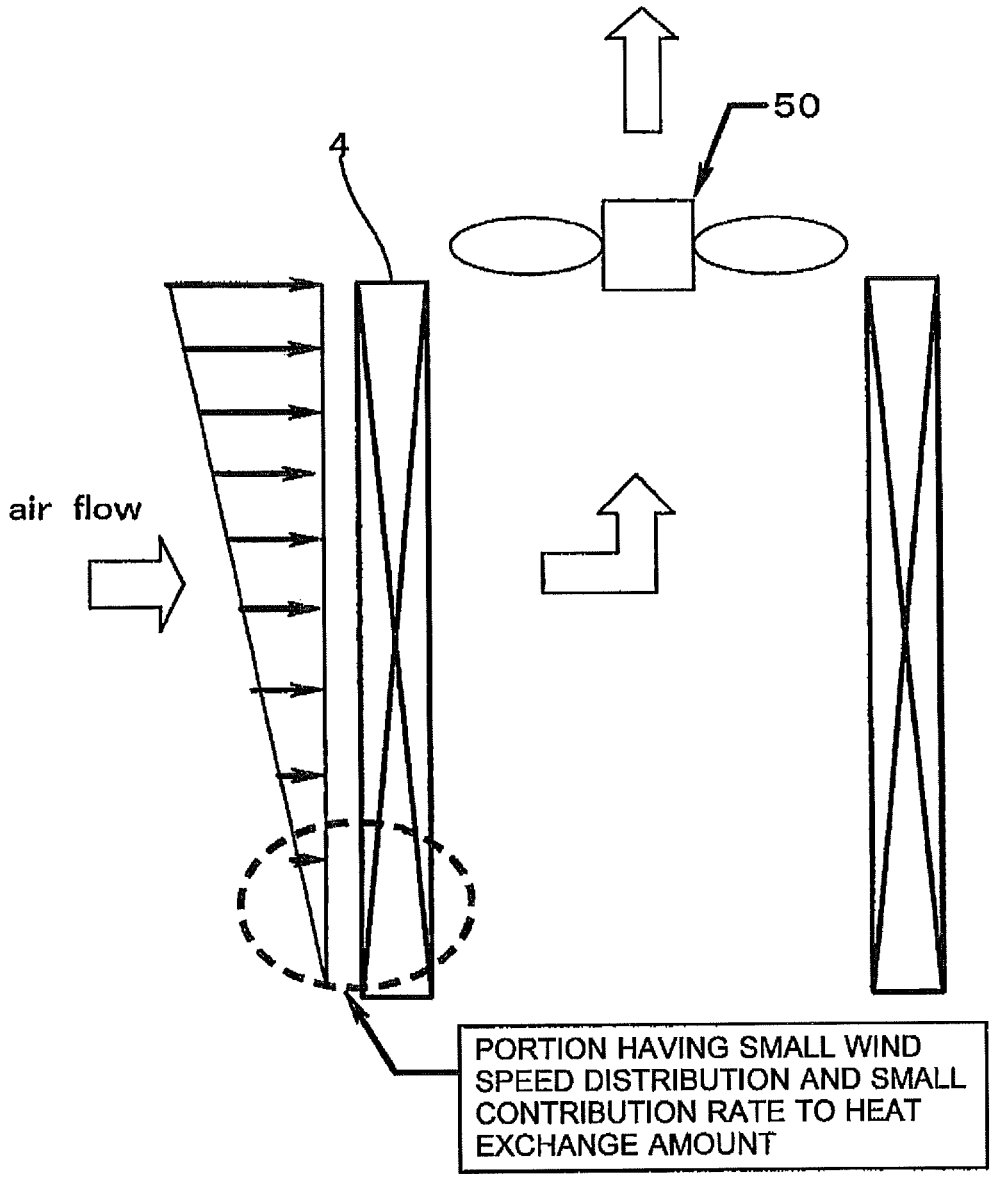
FIG. 2 is an illustrative diagram showing an example of the wind speed distribution on a surface of the heat source side heat exchanger.

FIG. 2 is an illustrative diagram showing an example of the wind speed distribution on a surface of the heat source side heat exchanger 4. Based on FIG. 2, descriptions will be given to the oil returning circuit 31 which is connected with the heat source side heat exchanger 4 along with the wind speed distribution on the surface of the heat source side heat exchanger 4. FIG. 2 illustrates the fan 50 as well. As mentioned above, the refrigerant and the refrigerator oil each flowing through the oil returning circuit 31 are adapted to flow through the portion of the heat source side heat exchanger 4. When the outdoor unit A has a configuration such that outdoor air is sucked from a side face and blown out to upward through the heat source side heat exchanger 4, a wind speed distribution shown in FIG. 2 is generated on the surface of the heat source side heat exchanger 4.

That is, in the heat source side heat exchanger 4 like this, the wind speed distribution becomes small from the upper section near the fan 50 to the lower section away from the fan 50. Because of the wind speed distribution like this, in the lower section where the wind speed distribution is small, contribution rate to the entire radiation amount of the heat source side heat exchanger 4 becomes small. However, the radiation amount is enough to radiate small amount of the high-pressure high-temperature gas refrigerant, which is a part separated in the oil separator 2. Consequently, the air-conditioner 100 makes the refrigerant and the refrigerator oil flow through the oil returning circuit 31 and exchange heat in a portion where the wind speed distribution of the heat source side heat exchanger 4 is the smallest. For example, when the fan 50 is provided at the upper part as shown in FIG. 2, the refrigerant and the refrigerator oil flowing through the oil returning circuit 31 may be made to exchange heat at a portion of from the intermediate position in a height direction to the lower side of the heat source side heat exchanger 4.

As mentioned above, the air-conditioner 100 is adapted to make part of the high-pressure high-temperature gas refrigerant and the refrigerator oil separated by the oil separator 2 release heat in the heat source side heat exchanger 4, then to return it to the compressor 1. Thereby, compared with a conventional air-conditioner where the high-pressure high-temperature gas refrigerant and the refrigerator oil are directly returned to the compressor suction side, enthalpy at the compressor suction side is reduced and refrigerant density at the compressor suction side increases. Accordingly, it is possible to suppress temperature rise at the compressor suction side. Further, since the gas refrigerant density sucked into the compressor 1 increases and the refrigerant circulation amount in the refrigeration circuit increases, the performance of the air-conditioner 100 is improved. The rise in the discharge temperature of the compressor 1 can be suppressed by suppressing the rise in the suction temperature, which contributes to the improvement of the reliability of the compressor 1 such as suppression of the rise in the motor wiring temperature.

Embodiment 2

Figure 3:
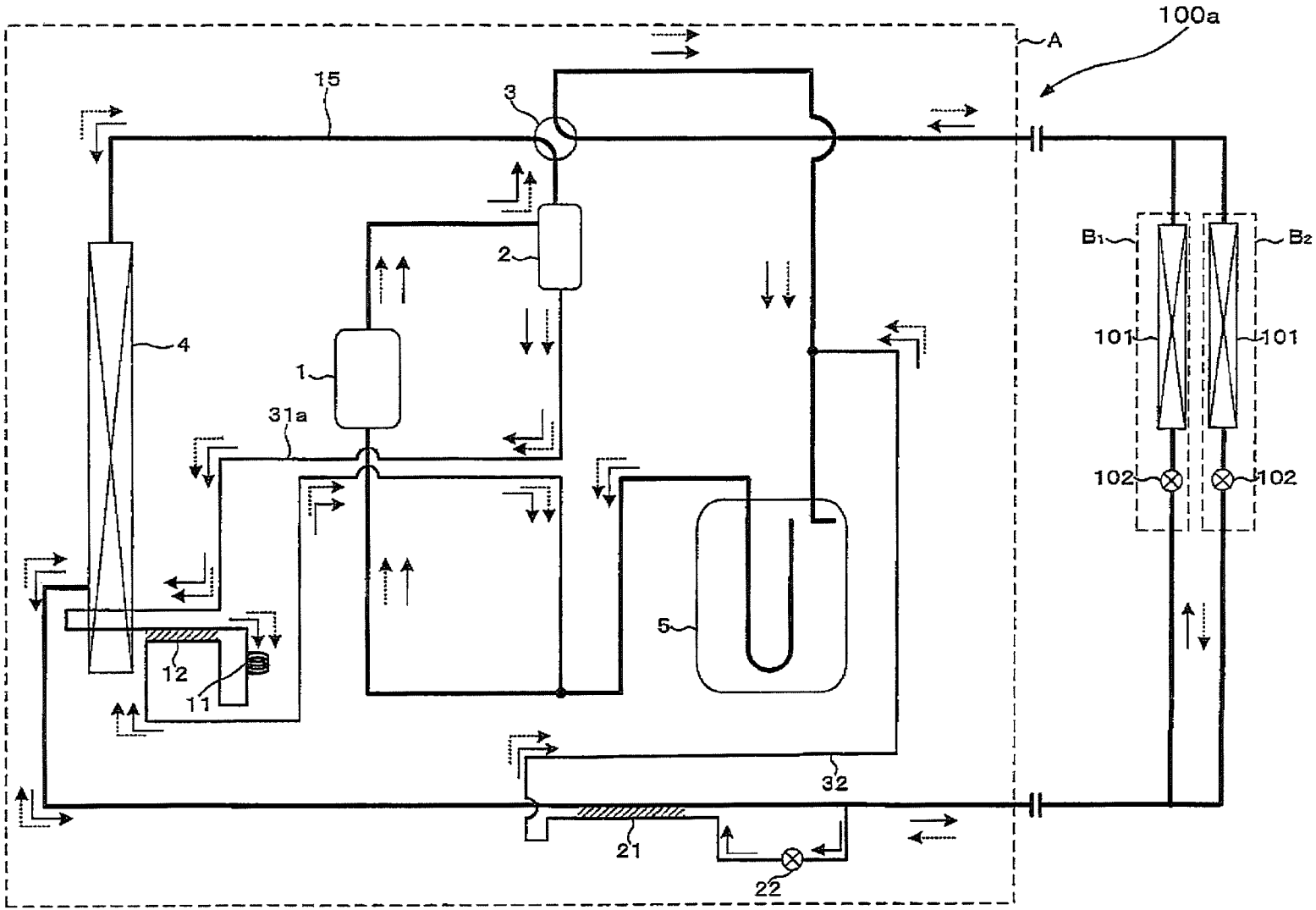
FIG. 3 is a refrigerant circuit diagram showing a refrigerant circuit configuration of an air-conditioner according to Embodiment 2.

FIG. 3 is a refrigerant circuit diagram showing a refrigerant circuit configuration of an air-conditioner 100*a* according to Embodiment 2. Based on FIG. 3, descriptions will be given to the refrigerant circuit configuration and operations of the air-conditioner 100*a*, which is one of refrigeration cycle apparatuses. The air-conditioner 100*a* performs a cooling operation or a heating operation using a refrigeration cycle that makes the refrigerant circulate. In FIG. 3, solid line arrows denote the refrigeration circuit at the time of the cooling operation and dotted line arrows denote the refrigeration circuit at the time of the heating operation, respectively. In Embodiment 2, the same signs are given to the same portions as Embodiment 1 and descriptions will be given focusing on differences from Embodiment 1.

In Embodiment 1, while descriptions are given to the air-conditioner 100, in which part of the high-pressure high-temperature gas refrigerant and the refrigerator oil separated by the oil separator 2 are adapted to be returned to the compressor 1 after being made to release heat in the heat source side heat exchanger 4, in Embodiment 2, descriptions will be given to the air-conditioner 100*a*, in which radiation effect is further improved. As shown in FIG. 3, although the basic refrigerant circuit configuration of the air-conditioner 100*a* is the same as the air-conditioner 100 according to Embodiment 1, the air-conditioner 100*a* is different from the air-conditioner 100 according to Embodiment 1 in that a super-cooling heat exchanger 12 is provided in the oil returning circuit (hereinafter, referred to as an oil returning circuit 31*a*).

The super-cooling heat exchanger 12 is provided between the heat source side heat exchanger 4 of the oil returning circuit 31*a* and the decompression mechanism 11 to exchange heat between part of the refrigerant separated in the oil separator 2 and made to release heat in the heat source side heat exchanger 4 and the refrigerant flowed out of the heat source side heat exchanger 4 and decompressed by the decompression mechanism 11. Consequently, in the air-conditioner 100*a*, part of the high-pressure high-temperature gas refrigerant and the refrigerator oil separated by the oil separator 2 can be made to further release heat in the super-cooling heat exchanger 12 after being made to release heat in the heat source side heat exchanger 4. As explained in Embodiment 1, the oil returning circuit 31*a* may install pipelines so as to exchange heat at a section where the wind speed distribution of the heat source side heat exchanger 4 is the smallest.

Descriptions will be given to the flow of the refrigerant and refrigerator oil in the oil returning circuit 31*a* of the air-conditioner 100*a*. The refrigerant flow at the time of various operations of the air-conditioner 100*a* is the same as that of the air-conditioner 100 according to Embodiment 1. The refrigerator oil brought out of the compressor 1 along with the refrigerant flows into the oil separator 2 and is separated from the high-pressure gas refrigerant in the oil separator 2. Part of the high-pressure high-temperature gas refrigerant and the refrigerator oil separated in the oil separator 2 flows into the portion of the heat source side heat exchanger 4 through the oil returning circuit 31*a* to the compressor 1. The high-pressure high-temperature gas refrigerant flowed into the portion of the heat source side heat exchanger 4 turns into a high-pressure medium-temperature liquid refrigerant by releasing heat in the heat source side heat exchanger 4.

The high-pressure medium-temperature liquid refrigerant and the refrigerator oil flowing out of the heat source side heat exchanger 4 flows into the condensation side of the super-cooling heat exchanger 12. In the super-cooling heat exchanger 12, the high-pressure medium-temperature liquid refrigerant and the refrigerator oil exchange heat with the low-pressure two-phase refrigerant and the refrigerator oil flowed into the evaporation side of the super-cooling heat exchanger 12 through the decompression mechanism 11 and turns into a super-cooled high-pressure medium-temperature liquid refrigerant and the refrigerator oil to flow into the decompression device. In the decompression mechanism 11, the high-pressure medium-temperature liquid refrigerant is decompressed to be a low-pressure low-temperature two-phase refrigerant and flows into the evaporation side of the super-cooling heat exchanger 12 along with the refrigerator oil. The low-pressure low-temperature two-phase refrigerant exchanges heat with the refrigerant and the refrigerator oil flowed into the condensation side of the super-cooling heat exchanger 12 and turns into a low-pressure low-temperature gas refrigerant to be returned into the suction side of the compressor 1 with the refrigerator oil.

As mentioned above, the air-conditioner 100 is adapted to make part of the high-pressure high-temperature gas refrigerant and the refrigerator oil separated by the oil separator 2 release heat in the heat source side heat exchanger 4, then return them to the compressor 1 after super-cooling in the super-cooling heat exchanger 12. Thereby, compared with a conventional air-conditioner where the high-pressure high-temperature gas refrigerant and the refrigerator oil are directly returned to the suction side of the compressor, enthalpy at the compressor suction side is reduced and refrigerant density at the compressor suction side increases. Accordingly, it is possible to suppress temperature rise at the suction side of the compressor.

Since the density of the gas refrigerant sucked into the compressor 1 increases and the refrigerant circulation amount increases, the performance of the air-conditioner 100*a* is improved. The rise in the discharge temperature of the compressor 1 can be suppressed by suppressing the rise in the suction temperature, which contributes to the improvement of the reliability of the compressor 1 such as suppression of the rise in the motor wiring temperature. In addition, in the air-conditioner 100*a*, since not the refrigerant under a low-pressure low-temperature two-phase state returns to the compressor 1 but a low-pressure gas refrigerant returns to the compressor 1, a liquid back ratio can be reduced as a liquid back amount against the refrigerant circulation amount of the compressor 1. Accordingly, it is possible to suppress dilution of the oil concentration in the compressor 1 and to improve reliability of the air-conditioner 100*a* further.

Embodiment 3

Figure 4:
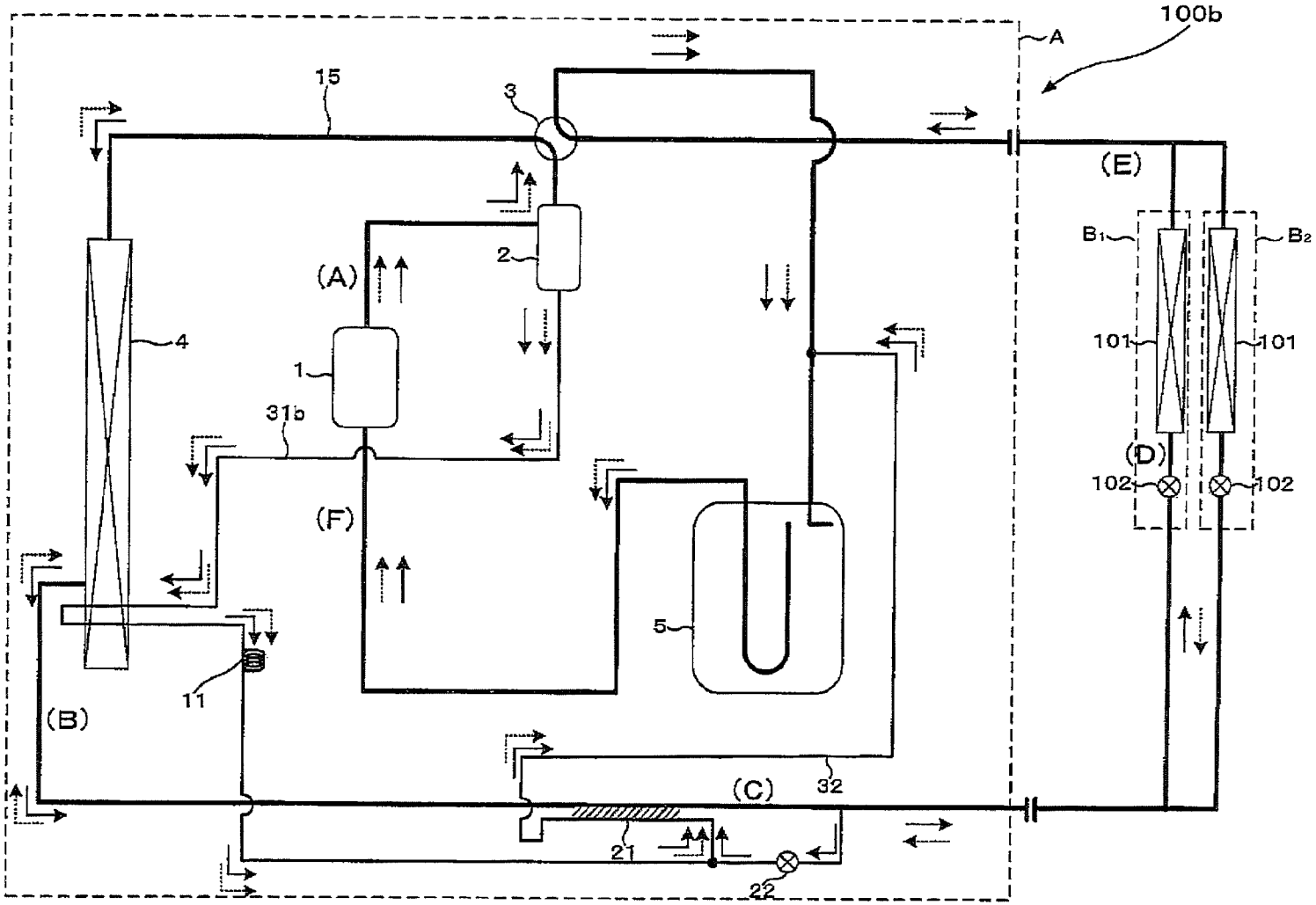
FIG. 4 is a refrigerant circuit diagram showing a refrigerant circuit configuration of an air-conditioner according to Embodiment 3.

FIG. 4 is a refrigerant circuit diagram showing a refrigerant circuit configuration of an air-conditioner 100*b* according to Embodiment 3 of the present invention. Based on FIG. 4, descriptions will be given to the refrigerant circuit configuration and operations of the air-conditioner 100*b*, which is one of refrigeration cycle apparatuses. The air-conditioner 100*b* performs a cooling operation or a heating operation using a refrigeration cycle that makes the refrigerant circulate. In FIG. 4, solid line arrows denote the refrigeration circuit at the time of the cooling operation and dotted line arrows denote the refrigeration circuit at the time of the heating operation, respectively. In Embodiment 3, the same signs are given to the same portions as Embodiments 1 and 2, and descriptions will be given focusing on differences from Embodiments 1 and 2.

Descriptions are given to an air-conditioner, in which while in Embodiment 1 part of the high-pressure high-temperature gas refrigerant and the refrigerator oil separated by the oil separator 2 are adapted to be returned to the compressor 1 after being made to release heat in the heat source side heat exchanger 4, and in Embodiment 2, part of the high-pressure high-temperature gas refrigerant and the refrigerator oil separated by the oil separator 2 are adapted to be returned to the compressor 1 after being made to release heat in the heat source side heat exchanger 4 and super-cooling heat exchanger 12, respectively. In Embodiment 3, descriptions will be given to the air-conditioner 100*b*, which is configured to further enhance performance improvement effect. As shown in FIG. 4, although the basic refrigerant circuit configuration of the air-conditioner 100*b* is the same as the air-conditioner 100 according to Embodiment 1 and the air-conditioner 100*a* according to Embodiment 2, the oil returning circuit (hereinafter, referred to as an oil returning circuit 31*b*) is different.

The oil returning circuit 31*b* leads the refrigerator oil and part of the refrigerant separated by the oil separator 2 through the portion of the heat source side heat exchanger 4 and the decompression mechanism 11 to the evaporation side inlet of the refrigerant-refrigerant heat exchanger 21, which is in between the refrigerant-refrigerant heat exchanger 21 and super-cooling expansion valve 22 of the bypass circuit 32. That is, in the air-conditioner 100*b*, the oil returning circuit 31*b* does not return the low-pressure low-temperature two-phase refrigerant and the refrigerator oil decompressed by the decompression mechanism 11 to the suction side of the compressor 1, but passes to join at the evaporation side inlet of the refrigerant-refrigerant heat exchanger 21. In addition, as explained in Embodiment 1, the oil returning circuit 31*b* may be installed by piping so as to exchange heat at a section where the wind speed distribution of the heat source side heat exchanger 4 is the smallest.

Figure 5:
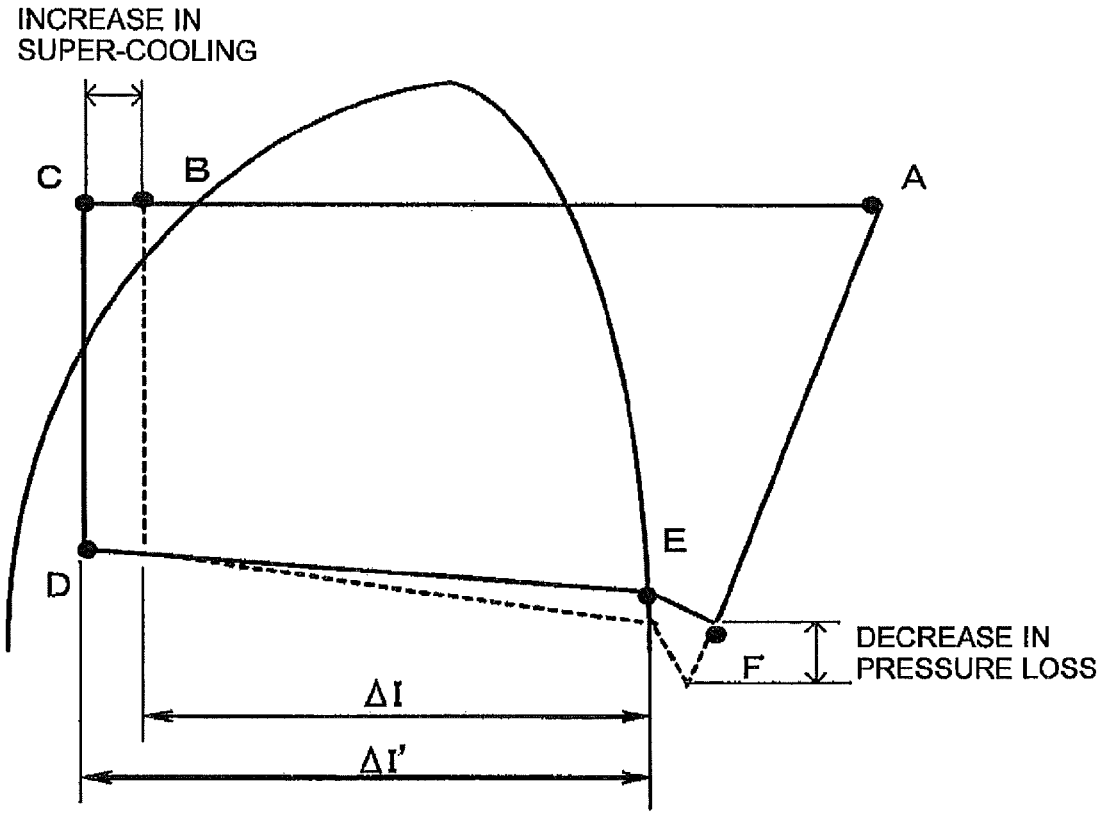
FIG. 5 is a Mollier diagram showing transitions of a refrigerant at the time of a cooling and a heating operation of the air-conditioner.

FIG. 5 is a Mollier diagram (a diagram showing the relation between the pressure of the refrigerant and enthalpy) showing transitions of the refrigerant at the time of the cooling operation of the air-conditioner 100*b*. Based on FIGS. 4 and 5, descriptions will be given to the refrigerant flow at the time of the cooling operation of the air-conditioner 100*b*. The refrigerant states at points "A" to "F" shown in FIG. 5 correspond to the refrigerant status at points "A" to "F" shown in FIG. 4. In FIG. 5, the vertical axis denotes pressure [MPa] and the horizontal axis denotes enthalpy [kJ/kg], respectively. In addition, as for the refrigerant flow at the time of the heating operation of the air-conditioner 100*b* is the same as that of the air-conditioner 100 according to Embodiment 1.

When the air-conditioner 100*b* performs the cooling operation (solid line arrows), the four-way valve 3 is switched so that the refrigerant discharged from the compressor 1 flows into the heat source side heat exchanger 4 and the compressor 1 is driven. The refrigerant sucked by the compressor 1 turns into a high-pressure high-temperature gas state in the compressor 1 and is discharged (status "A") to flow into the heat source side heat exchanger 4 via the oil separator 2 and the four-way valve 3. The refrigerant flowed into the heat source side heat exchanger 4 is cooled while releasing heat to the air supplied from the fan not shown and turns into a low-pressure high-temperature liquid refrigerant to flow out from the heat source side heat exchanger 4 (status "B").

The liquid refrigerant flowed out of the heat source side heat exchanger 4 flows into the condensation side of the refrigerant-refrigerant heat exchanger 21. The refrigerant flowed into the refrigerant-refrigerant heat exchanger 21 exchanges heat with the low-pressure two-phase refrigerant flowing through the evaporation side of the refrigerant-refrigerant heat exchanger 21 and is subjected to super-cooling (status "C"). Part of the high-pressure liquid refrigerant flowed out of the refrigerant-refrigerant heat exchanger 21 and subjected to super-cooling flows out from the indoor unit A to flow into the indoor unit B. The refrigerant flowed into the indoor unit B is decompressed by the throttle device 102 to turn into a low-pressure two-phase refrigerant (status "D").

On the other hand, part of the high-pressure liquid refrigerant flowed out of the refrigerant-refrigerant heat exchanger 21 and subjected to super-cooling flows into the bypass circuit 32. The liquid refrigerant flowed into the bypass circuit 32 is decompressed by the super-cooling expansion valve 22 to turn into a low-pressure two-phase refrigerant. The refrigerant turned into the low-pressure two-phase refrigerant in the super-cooling expansion valve 22 flows into the evaporation side of the refrigerant-refrigerant heat exchanger 21 and exchanges heat with the high-pressure liquid refrigerant at the condensation side of the refrigerant-refrigerant heat exchanger 21 to turn into a low-pressure gas refrigerant (status "E"). The low-pressure gas refrigerant flowed out of the evaporation side of the refrigerant-refrigerant heat exchanger 21 is led between the four-way valve 3 and the accumulator 5 and flows into the accumulator 5 to finally return to the compressor 1.

Thereby, when the high-pressure liquid refrigerant flowing into the throttle device 102 at the indoor unit B side is subjected to super-cooling, enthalpy decreases and in the case where capacity is constant, the refrigerant flow amount into the indoor unit B can be reduced by the amount corresponding to the reduction of enthalpy. That is, since it is expressed that capacity Q=refrigerant flow amount Gr*difference enthalpy $\Delta l$ at the inlet/outlet of the evaporator (use side heat exchanger 101), enthalpy decreases by making the high-pressure liquid refrigerant subjected to super-cooling, allowing the refrigerant flow amount Gr to be small (Gr') by the amount ($\Delta l'$) corresponding to the amount by which difference enthalpy $\Delta l$ could be made large.

In the case of cooling, since a pressure loss in the use side heat exchanger 101 at the load side and a pressure loss in the low-pressure line from the outlet of the use side heat exchanger 101 to the suction of the compressor are decreased (status "E" to "F") by the amount by which the refrigerant flow amount to the indoor unit B can be reduced, the suction pressure of the compressor 1 can be increased. Accordingly, since the suction pressure of the compressor 1 can be increased, the refrigerant flow amount of the compressor 1 itself increases to enhance the capacity of the compressor 1. Since the operation frequency in proportion to the push-aside amount of the compressor 1 can be reduced as much as the increased capacity of the compressor 1, power consumption is decreased and performance is improved resultantly.

Descriptions will be given to the refrigerant flow in the oil returning circuit 31*b* of the air-conditioner 100*b*. The refrigerator oil brought out of the compressor 1 along with the refrigerant flows into the oil separator 2 and separated from the high-pressure gas refrigerant in the oil separator 2. Part of the high-pressure high-temperature gas refrigerant and the refrigerator oil separated in the oil separator 2 flows into the portion of the heat source side heat exchanger 4 through the oil returning circuit 31*b* to the compressor 1. The high-pressure high-temperature gas refrigerant flowed into the portion of the heat source side heat exchanger 4 turns into a high-pressure medium-temperature liquid refrigerant by releasing heat in the heat source side heat exchanger 4.

The high-pressure medium-temperature liquid refrigerant flowed out of the heat source side heat exchanger 4 turns into a low-pressure low-temperature two-phase refrigerant in the decompression mechanism 11 and merges with the low-pressure two-phase refrigerant flowing through the bypass circuit 32 via the super-cooling expansion valve 22 to flow into the evaporation side of the refrigerant-refrigerant heat exchanger 21. The low-pressure two-phase exchanges heat with the refrigerant flowing through the condensation side of the refrigerant-refrigerant heat exchanger 21, turns into a low-pressure low-temperature gas refrigerant, being guided between the four-way valve 3 and the accumulator 5 along with the refrigerator oil, and flows into the accumulator 5 to finally return to the compressor 1.

As mentioned above, the air-conditioner 100*b* makes part of the high-pressure high-temperature gas refrigerant and the refrigerator oil separated by the oil separator 2 release heat in the heat source side heat exchanger 4, merge into the high-pressure medium-temperature liquid refrigerant transferred to the indoor unit B at the evaporation side inlet of the refrigerant-refrigerant heat exchanger 21 in order to subject to super-cooling in the refrigerant-refrigerant heat exchanger 21, and then return to the compressor 1. Thereby, compared with a conventional air-conditioner where the high-pressure high-temperature gas refrigerant and the refrigerator oil are directly returned to the compressor suction side, the refrigerant flow amount to the evaporation side of the refrigerant-refrigerant heat exchanger 21 increases.

Consequently, if the difference enthalpy Δl that satisfies a predetermined capacity Q is constant, the bypass flow amount from the super-cooling expansion valve 22 can be reduced by the amount of increase in the refrigerant flow amount to the evaporation side of the refrigerant-refrigerant heat exchanger 21. Therefore, the refrigerant flow amount to the indoor unit B increases by the reduction. When the refrigerant flow amount to the indoor unit B increases, capacity is enhanced. Therefore, the operation capacity (operation frequency in proportion to the push-aside amount of the compressor 1) of the compressor 1 can be reduced by the amount of the enhanced capacity, power consumption is decreased and performance is improved resultantly For example, when the refrigerant flow amount Gb1 made to bypass by the oil separator 2 is 5% and the bypass refrigerant flow amount Gb2 to the evaporation side of the refrigerant-refrigerant heat exchanger 21 is 15% against the entire refrigerant flow amount G discharged from the compressor 1, the refrigerant flow among Gr having flowed into the indoor unit B becomes Gr=G−Gb1−Gb2=100%−5%−15%=80%. If the refrigerant flow amount Gb1 made to bypass by the oil separator 2 is made to join the bypass refrigerant flow amount Gb2 to the evaporation side of the refrigerant-refrigerant heat exchanger 21 in place of directly being returned to the suction side of the compressor, the flow amount will be Gb2=5%+15%=20%, resulting in an excess of 5% from Gb2=15%, which is originally required.

Therefore, by reducing the refrigerant flow amount from the super-cooling expansion valve 22 by 5% to make it be 10%, that is the original value, Gb2=5%+(15−5%) can be achieved, allowing the excess amount 5% to flow into the indoor unit B. That is, the excess amount 5% flows as the refrigerant amount Gr to the indoor unit B, resulting in the increase in the refrigerant amount Gr flowing into the indoor unit B up to 85%. The operation capacity of the compressor 1 can be reduced by the increased amount 5% and power consumption is decreased, resulting in the improvement of performance.

Since the temperature rise in the suction side of the compressor is suppressed and the gas refrigerant density increases, the refrigerant circulation amount of the compressor 1 increases, which is a multiplier effect, allowing the performance of the air-conditioner 100*b* to be further improved. Moreover, the rise in the discharge temperature of the compressor 1 can be suppressed by suppressing the rise in the suction temperature, resulting in the contribution to the improvement of reliability of the compressor 1 such as control of the rise in the motor winding temperature. In addition, since no refrigerant flow amount bypassed by the oil separator 2 is directly returned to the compressor 1, the operation frequency in proportion to the push-aside amount of the compressor 1 can be reduced, allowing power consumption to be further decreased and performance to be improved resultantly.

REFERENCE SIGNS LIST

1 compressor
2 oil separator
3 four-way valve
4 heat source side heat exchanger
5 accumulator
11 decompression mechanism
12 super-cooling heat exchanger
15 refrigerant pipeline
21 refrigerant-refrigerant heat exchanger
22 super-cooling expansion valve
31, 31*a*, 31*b* oil returning circuit
32 bypass circuit
50 fan
100, 100*a*, 100*b* air-conditioner
101 use side heat exchanger
102 throttle device
A outdoor unit
B, $B_1$, $B_2$ indoor unit

The invention claimed is:

1. An air-conditioner comprising:

a refrigerant circuit, in which a compressor, an oil separator, a heat source side heat exchanger, a refrigerant-refrigerant heat exchanger, a throttle device, and a use side heat exchanger are connected in order;

a bypass circuit that connects between said refrigerant-refrigerant heat exchanger and said throttle device in said refrigerant circuit with the suction side of said compressor via said refrigerant-refrigerant heat exchanger;

a super-cooling expansion valve provided at the upstream side of said refrigerant-refrigerant heat exchanger in said bypass circuit; and an oil return circuit that connects said oil separator to said bypass circuit between said super-cooling expansion valve and said refrigerant-refrigerant heat exchanger, wherein refrigerator oil separated by said oil separator flows through at least part of said heat source side heat exchanger to exchange heat, and through a decompression mechanism, joins with refrigerant that has flowed out of said super-cooling expansion valve, and flows into said refrigerant-refrigerant heat exchanger.

2. The air-conditioner according to claim 1, further including a fan, which supplies air to said heat source side heat exchanger, above said heat source side heat exchanger, wherein said oil return circuit is installed by piping so as to exchange heat with a part of a lower side from an intermediate position in a height direction of said heat source side heat exchanger.

3. A refrigerator oil returning method of the air-conditioner according to claim 1, comprising:

separating the refrigerator oil by said oil separator, leading said refrigerator oil to the part of said heat source side heat exchanger along with a part of remaining refrigerant that had not been separated by said oil separator, leading said refrigerator oil to the evaporation side of said refrigerant-refrigerant heat exchanger after being made to release heat, and returning said refrigerator oil to the suction side of said compressor after being made to exchange heat with the refrigerant flowing at the condensation side of said refrigerant-refrigerant heat exchanger.

* * * * *